US008550160B2

(12) United States Patent
Proett

(10) Patent No.: US 8,550,160 B2
(45) Date of Patent: Oct. 8, 2013

(54) APPARATUS AND METHODS FOR PULSE TESTING A FORMATION

(75) Inventor: Mark A. Proett, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 542 days.

(21) Appl. No.: 12/673,067

(22) PCT Filed: Aug. 15, 2008

(86) PCT No.: PCT/US2008/073372
§ 371 (c)(1),
(2), (4) Date: Mar. 25, 2010

(87) PCT Pub. No.: WO2009/023852
PCT Pub. Date: Feb. 19, 2009

(65) Prior Publication Data

US 2011/0094733 A1 Apr. 28, 2011

Related U.S. Application Data

(60) Provisional application No. 60/956,095, filed on Aug. 15, 2007.

(51) Int. Cl.
*E21B 49/10* (2006.01)

(52) U.S. Cl.
USPC ..... 166/264; 175/50; 73/152.24

(58) Field of Classification Search
USPC .... 166/264, 100; 175/50; 73/152.24–152.28
See application file for complete search history.

(56) References Cited

U.S. PATENT DOCUMENTS

| | | | |
|---|---|---|---|
| 6,871,713 | B2 | 3/2005 | Meister et al. |
| 7,216,533 | B2 | 5/2007 | McGregor et al. |
| 2004/0011525 | A1 | 1/2004 | Jones et al. |
| 2007/0181341 | A1 | 8/2007 | Segura et al. |

OTHER PUBLICATIONS

International Search Report and Written Opinion for Appl. No. PCT/US2008/073372 dated Jan. 29, 2009; (9 p.).

*Primary Examiner* — David Andrews
(74) *Attorney, Agent, or Firm* — Conley Rose, P.C.

(57) ABSTRACT

Apparatus and methods for measuring properties of formation material and fluid in a borehole wall. In some embodiments, the apparatus includes a cylinder with a drawdown piston slideably disposed therein, a probe assembly and a passageway configured to provide fluid communication between the probe assembly and the cylinder. The probe assembly has a housing, a piston slideably disposed within the housing, the piston having a throughbore and a pad coupled thereto, and a tubular slideably disposed within the throughbore. The drawdown piston is translatable from a first position toward a second position to draw fluid into the probe assembly, the passageway and the cylinder, and translatable from the second position toward the first position to increase pressure of fluid in the passageway.

23 Claims, 14 Drawing Sheets

1
2
3
4
9
8
150
5
6
10
13
151
1
11

APPARATUS AND METHODS FOR PULSE TESTING A FORMATION

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities). These tests are performed in order to determine whether commercial exploitation of the intersected formations is viable and how to optimize production.

Wireline formation testers (WFT) and drill stem testers (DST) have been commonly used to perform these tests. The basic DST tool consists of a packer or packers, valves, or ports that may be opened and closed from the surface, and one or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart the pressure transients. A sampling chamber traps formation fluid at the end of the test. WFTs generally employ the same testing techniques but use a wireline to lower the test tool into the borehole after the drill string has been retrieved from the borehole. The WFT typically uses packers also, although the packers typically isolate a much smaller borehole area, compared to DSTs, for more efficient formation testing. In most cases, the WFT do not use conventional packers but rather probe devices that isolate only a small circular region on the borehole wall.

The WFT probe assembly engages the borehole wall and acquires formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

In order to acquire a useful sample, the probe must stay isolated from the relative high pressure of the borehole fluid. Therefore, the integrity of the seal that is formed by the isolation pad is critical to the performance of the tool. If the borehole fluid is allowed to leak into the collected formation fluid, a non-representative sample and pressure measurement will be obtained and the test will have to be repeated.

Examples of isolation pads and probes used in WFTs can be found in Halliburton's DT, SFTT, SFT4, and RDT tools. Isolation pads that are used with WFTs are typically rubber pads affixed to the end of the extending sample probe. The rubber is normally affixed to a metallic plate that provides support to the rubber as well as a connection to the probe. These rubber pads are often molded to fit within the specific diameter hole in which they will be operating.

With the use of WFTs and DSTs, the drill string with the drill bit must first be retracted from the borehole. Then, a separate work string containing the testing equipment, or, with WFTs, the wireline tool string, must be lowered into the well to conduct secondary operations.

DSTs and WFTs may also cause tool sticking or formation damage. Sticking occurs when the tool's body contacts the borehole for an extended period of time. A seal is formed and the differential pressure between the borehole and the formation draws the tool in close contact with the formation and causes the tool to be stuck. Formation damage occurs due to the extended periods the borehole is in the presence of hydrostatic pressures causing drilling fluid invasion to continue. There may also be difficulties of running WFTs in highly deviated and extended reach wells. When sticking or tight sections are encountered only the wireline can be used to retrieve the stuck tool. WFTs also do not have flowbores for the flow of drilling mud that helps prevent sticking. WFTs are also not designed to withstand drilling loads such as torque and weight on bit.

Further, the formation pressure measurement accuracy of drill stem tests and, especially, of wireline formation tests may be affected by mud filtrate invasion and mudcake buildup because significant amounts of time may have passed before a DST or WFT engages the formation after the borehole has been drilled. Mud filtrate invasion occurs when the drilling mud fluids displace formation fluid. Because the mud filtrate ingress into the formation begins at the borehole surface, it is most prevalent there and generally decreases further into the formation. When filtrate invasion occurs, it may become impossible to obtain a representative sample of formation fluid or, at a minimum, the duration of the sampling period must be increased to first remove the drilling fluid and then obtain a representative sample of formation fluid. Mudcake buildup occurs when any solid particles in the drilling fluid are plastered to the side of the wellbore by the circulating drilling mud during drilling. This mudcake helps to isolate and impede the invasion. Frequently, the mud filtrate carries particles into the formation pore spaces, significantly reducing the permeability near the borehole surface. Thus there may be a "skin effect". Because formation testers' pressure transient can only extend relatively short distances into the formation, the measurement of formation permeability can be distorted. The skin effect also reduces the flow rate into the tool thereby impeding the tester's ability to obtain a representative sample of formation fluid. While the mudcake also acts as a region of reduced permeability adjacent to the borehole, it is essential to reducing filtrate invasion. Essentially, the mudcake is the primary seal and aids in obtaining accurate reservoir pressure measurements and formation samples. Normally the mudcake is easily penetrated by WFT probes and zones isolated with inflatable packers. However, the internal skin can reduce the tester's abilities.

Another testing apparatus is the formation tester while drilling (FTWD) tool. Typical FTWD formation testing equipment is suitable for integration with a drill string during drilling operations. Various devices or systems are used for isolating a formation from the remainder of the borehole, drawing fluid from the formation, and measuring physical properties of the fluid and the formation. Fluid properties, among other items, may include fluid compressibility, flowline fluid compressibility, density, viscosity, resistivity, composition, and bubblepoint. For example, the FTWD may use a probe similar to a WFT that extends to the formation and a small sample chamber to draw in formation fluid through the probe to test the formation pressure.

To perform a test, the drill string is stopped from rotating and moving axially and the test procedure is performed. The FTWD tool is positioned over the formation to form a seal between the tool and the formation, thereby isolating the formation from the remainder of the borehole. Fluid is then drawn from the formation into a sample chamber contained within the tool. The sample chamber may be formed by a cylinder within the tool and the sealed formation. The volume of the sample chamber may be increased or decreased by translating a piston within the cylinder. To break through the mudcake seal over the formation and to initiate fluid flow from the formation into the sample chamber, the piston is translated to increase the volume of the sample chamber, thereby lowering the fluid pressure inside the sample chamber. This process is referred to as drawdown. After drawdown is completed, formation fluid continues to flow into the sample chamber. The pressure of fluid inside the sample chamber is monitored and recorded until it reaches the formation pressure. The length of time required to complete this buildup process may be lengthy, causing the loss of valuable drilling rig time. This may be particularly so in low permeability or low mobility formations. For example, less than 1 md/cp.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
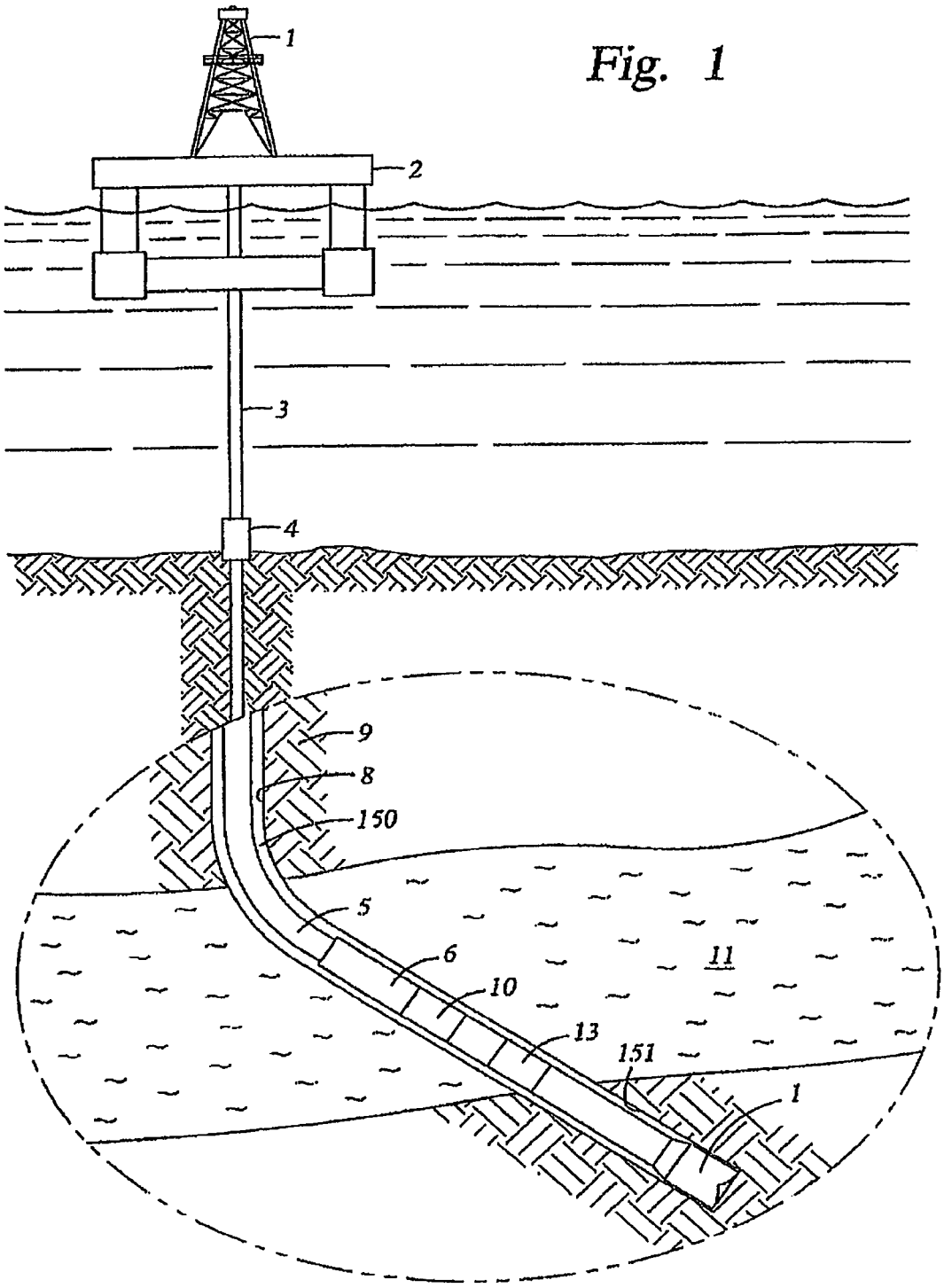
FIG. 1 is a schematic elevation view, partly in cross-section, of an embodiment of the formation tester apparatus disposed in a subterranean well.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples", and "coupled" used to describe any electrical connections are each intended to mean and refer to either an indirect or a direct electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom of the borehole. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring to FIG. 1, an example formation tester 10 is illustrated as a part of bottomhole assembly 6 (BHA) that comprises an MWD sub 13 and a drill bit 7 at its lower most end. The BHA 6 is lowered from a drilling platform 2, such as a ship or other conventional platform, via a drill string 5. The drill string 5 is disposed through a riser 3 and a well head 4. Conventional drilling equipment (not shown) is supported within the derrick 1 and rotates the drill string 5 and the drill bit 7, causing the bit 7 to form a borehole 8 through the formation material 9. The borehole 8 penetrates subterranean zones or reservoirs, such as a reservoir 11. It should be understood that the formation tester 10 may be employed in other bottomhole assemblies and with other drilling apparatus in land-based drilling, as well as offshore drilling as shown in FIG. 1. In all instances, in addition to formation tester 10, the BHA 6 may contain various conventional apparatus and systems, such as a downhole drill motor, mud pulse telemetry system, measurement-while-drilling sensors and systems, and others well known in the art.

It should also be understood that, even though the formation tester 10 is shown as part of a drill string 5, the embodiments of the invention described below may be conveyed down the borehole 8 via wireline technology, as is partially described above. It should also be understood that the exact physical configuration of the formation tester and the probe assembly is not a requirement of the present invention. The embodiment described below serves to provide an example only.

The exemplary formation tester tool 10 is best understood with reference to FIGS. 2A-2E. The formation tester 10 generally comprises a heavy walled housing 12 made of multiple sections of drill collar 12*a*, 12*b*, 12*c*, and 12*d* which threadingly engage one another so as to form the complete housing 12. The BHA 6 includes a flow bore 14 formed through its entire length to allow passage of drilling fluids from the surface through the drill string 5 and through the bit 7. The drilling fluid passes through nozzles in the drill bit face and flows upwards through the borehole 8 along the annulus 150 formed between the housing 12 and the borehole wall 151.

Figure 2A:
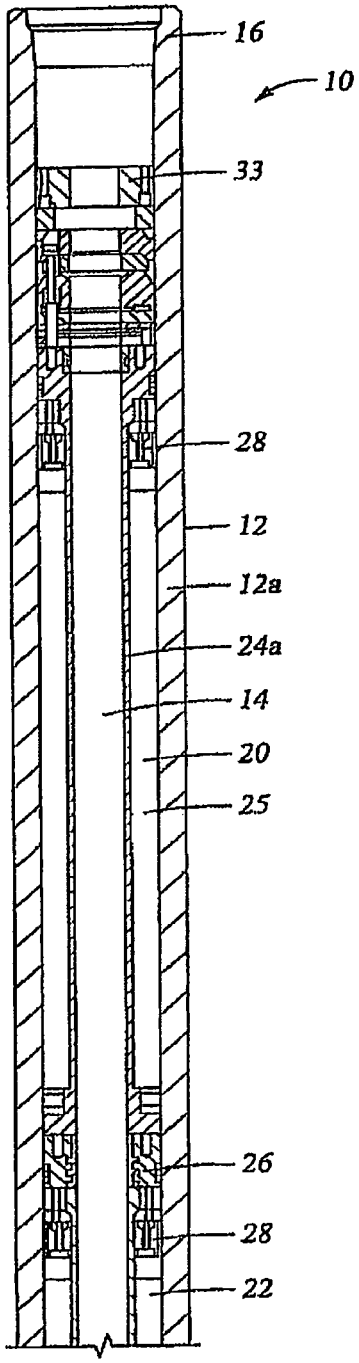
FIGS. 2A-2E are schematic elevation views, partly in cross-section, of portions of the bottomhole assembly and formation tester assembly shown in FIG. 1.
Figure 2B:
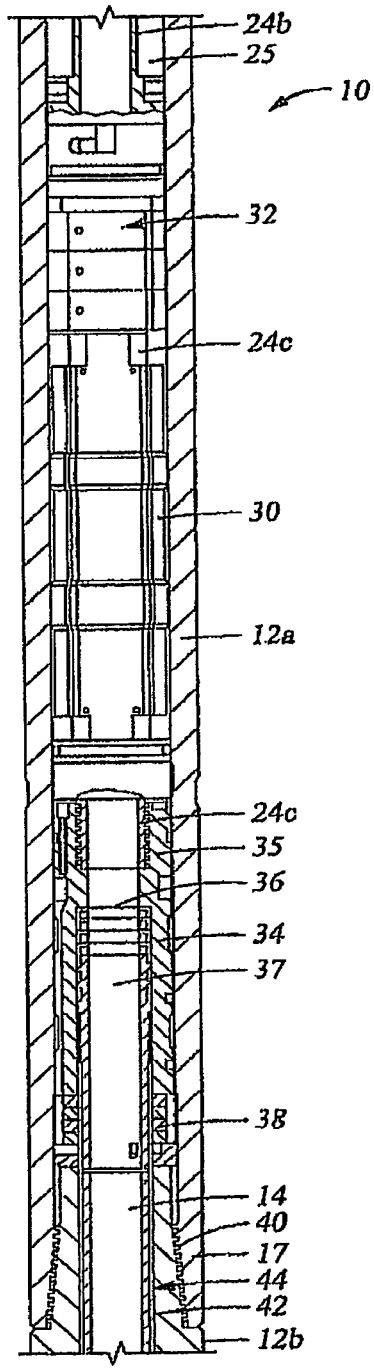

Referring to FIGS. 2A and 2B, upper section 12*a* of housing 12 includes upper end 16 and lower end 17. Upper end 16 includes a threaded box for connecting formation tester 10 to drill string 5. Lower end 17 includes a threaded box for receiving a correspondingly threaded pin end of housing section 12*b*. Disposed between ends 16 and 17 in housing section 12*a* are three aligned and connected sleeves or tubular inserts 24*a,b,c* which creates an annulus 25 between sleeves 24*a,b,c* and the inner surface of housing section 12*a*. The annulus 25 is sealed from flowbore 14 and provided for housing a plurality of electrical components, including battery packs 20, 22. Battery packs 20, 22 are mechanically interconnected at connector 26. Electrical connectors 28 are provided to interconnect battery packs 20, 22 to a common power bus (not shown). Beneath battery packs 20, 22 and also disposed about sleeve insert 24*c* in annulus 25 is electronics module 30. Electronics module 30 includes the various circuit boards, capacitors banks and other electrical components, including the capacitors shown at 32. A connector 33 is provided adjacent upper end 16 in housing section 12*a* to electrically couple the electrical components in formation tester tool 10 with other components of bottomhole assembly 6 that are above housing 12.

Beneath electronics module 30 in housing section 12*a* is an adapter insert 34. Adapter 34 connects to sleeve insert 24*c* at connection 35 and retains a plurality of spacer rings 36 in a central bore 37 that forms a portion of flowbore 14. Lower end 17 of housing section 12*a* connects to housing section 12*b* at threaded connection 40. Spacers 38 are disposed between the lower end of adapter 34 and the pin end of housing section 12*b*. Because threaded connections such as connection 40, at various times, need to be cut and repaired, the length of sections 12*a*, 12*b* may vary in length. Employing spacers 36, 38 allow for adjustments to be made in the length of threaded connection 40.

Housing section 12*b* includes an inner sleeve 44 disposed therethrough. Sleeve 44 extends into housing section 12*a* above, and into housing section 12*c* below. The upper end of sleeve 44 abuts spacers 36 disposed in adapter 34 in housing section 12*a*. An annular area 42 is formed between sleeve 44 and the wall of housing 12*b* and forms a wire way for electrical conductors that extend above and below housing section 12*b*, including conductors controlling the operation of formation tester 10 as described below.

Figure 2C:
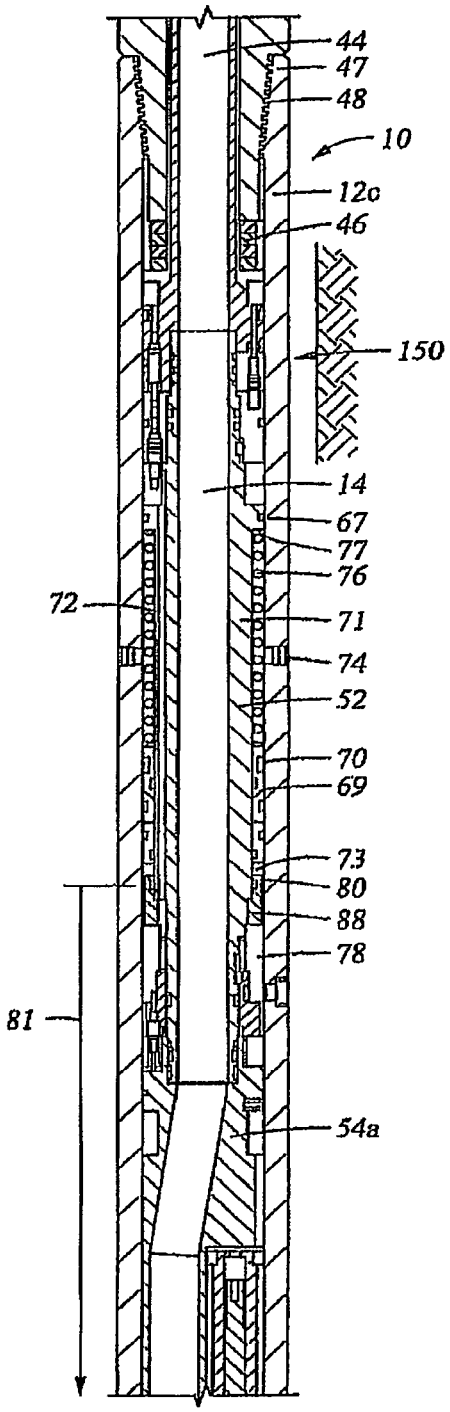
Figure 5:
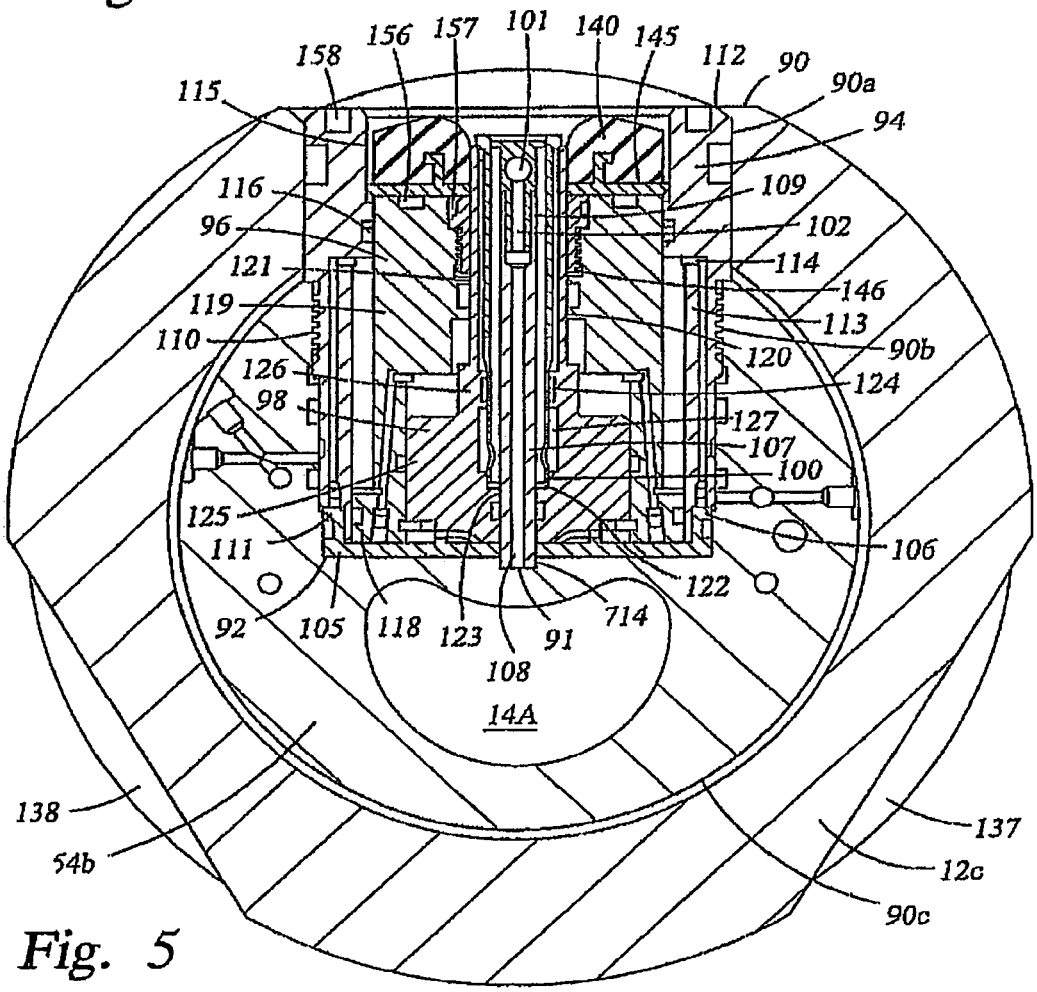
FIG. 5 is a cross-sectional view of the formation probe assembly taken along line 5-5 shown in FIG. 4.

Referring now to FIGS. 2B and 2C, housing section 12*c* includes upper box end 47 and lower box end 48 that threadingly engage housing section 12*b* and housing section 12*c*, respectively. For the reasons previously explained, adjusting spacers 46 are provided in housing section 12*c* adjacent to end 47. As previously described, insert sleeve 44 extends into housing section 12*c* where it stabs into inner mandrel 52. The lower end of inner mandrel 52 stabs into the upper end of formation tester mandrel 54, which is comprised of three axially aligned and connected sections 54*a, b*, and *c*. Extending through mandrel 54 is a deviated flowbore portion 14*a*. Deviating flowbore 14 into flowbore path 14*a* provides sufficient space within housing section 12*c* for the formation tool components described in more detail below. As best shown in FIG. 2E, deviated flowbore 14*a* eventually centralizes near the lower end 48 of housing section 12*c*, shown generally at location 56. Referring momentarily to FIG. 5, the cross-sectional profile of deviated flowbore 14*a* may be a non-circular in segment 14*b*, so as to provide as much room as possible for the formation probe assembly 50.

Figure 2D:
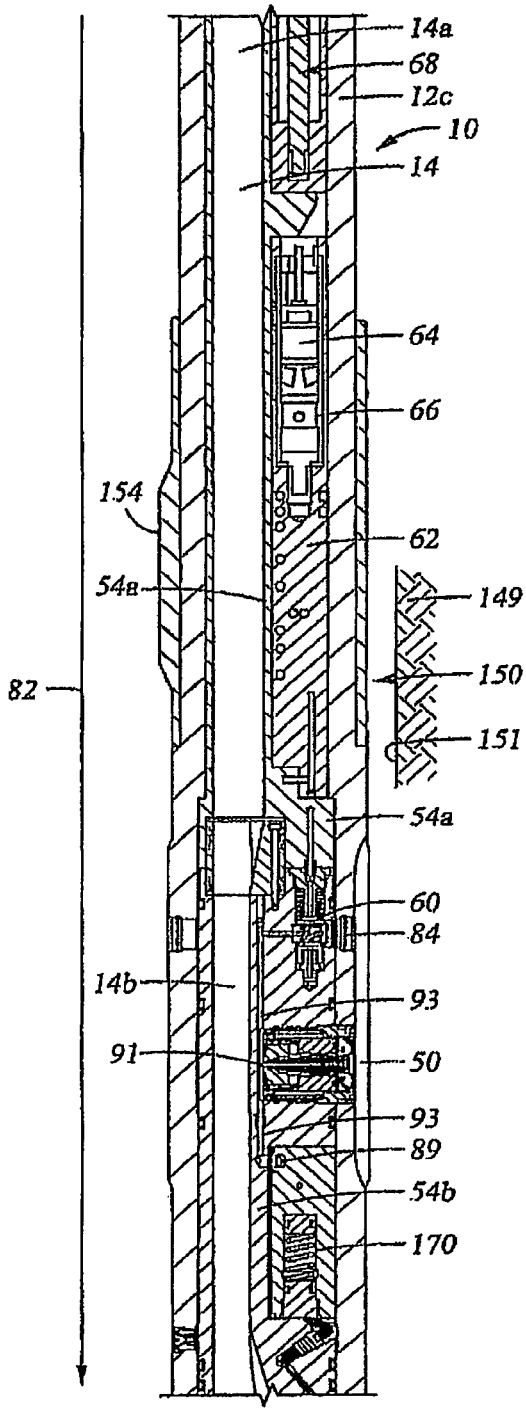
Figure 2E:
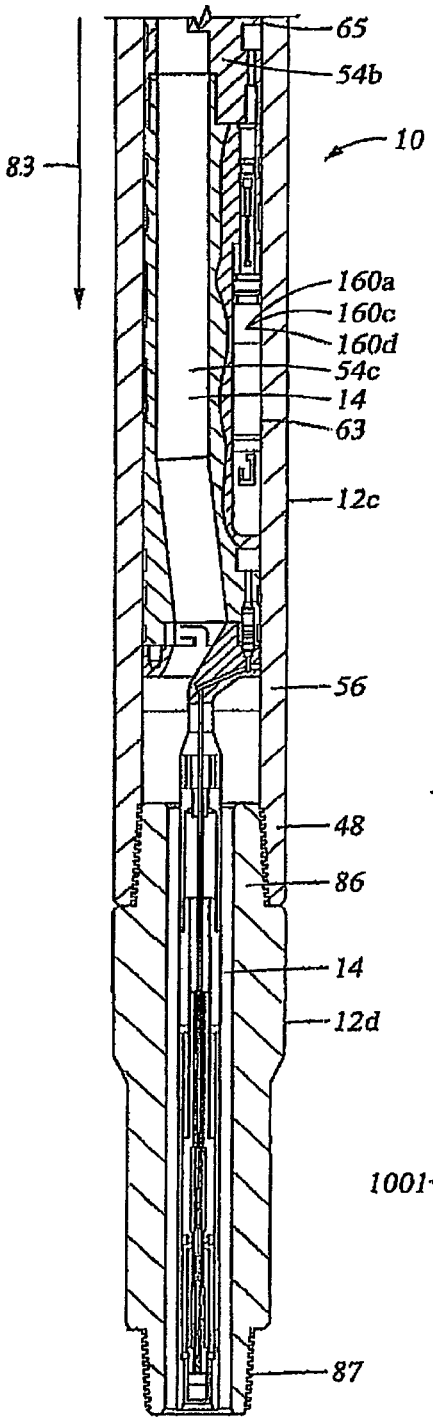

As best shown in FIGS. 2D and 2E, disposed about formation tester mandrel 54 and within housing section 12*c* are electric motor 64, hydraulic pump 66, hydraulic manifold 62, equalizer valve 60, formation probe assembly 50, pressure transducers 160, and drawdown piston 170. Hydraulic accumulators provided as part of the hydraulic system for operating formation probe assembly 50 are also disposed about mandrel 54 in various locations, one such accumulator 68 being shown in FIG. 2D.

Electric motor 64 may be a permanent magnet motor powered by battery packs 20, 22 and capacitor banks 32. Motor 64 is interconnected to and drives hydraulic pump 66. Pump 66 provides fluid pressure for actuating formation probe assembly 50. Hydraulic manifold 62 includes various solenoid valves, check valves, filters, pressure relief valves, thermal relief valves, pressure transducer 160*b* and hydraulic circuitry employed in actuating and controlling formation probe assembly 50 as explained in more detail below.

Referring again to FIG. 2C, mandrel 52 includes a central segment 71. Disposed about segment 71 of mandrel 52 are pressure balance piston 70 and spring 76. Mandrel 52 includes a spring stop extension 77 at the upper end of segment 71. Stop ring 88 is threaded to mandrel 52 and includes a piston stop shoulder 80 for engaging corresponding annular shoulder 73 formed on pressure balance piston 70. Pressure balance piston 70 further includes a sliding annular seal or barrier 69. Barrier 69 consists of a plurality of inner and outer o-ring and lip seals axially disposed along the length of piston 70.

Beneath piston 70 and extending below inner mandrel 52 is a lower oil chamber or reservoir 78, described more fully below. An upper chamber 72 is formed in the annulus between central portion 71 of mandrel 52 and the wall of housing section 12*c*, and between spring stop portion 77 and pressure balance piston 70. Spring 76 is retained within chamber 72. Chamber 72 is open through port 74 to annulus 150. As such, drilling fluids will fill chamber 72 in operation. An annular seal 67 is disposed about spring stop portion 77 to prevent drilling fluid from migrating above chamber 72.

Barrier 69 maintains a seal between the drilling fluid in chamber 72 and the hydraulic oil that fills and is contained in oil reservoir 78 beneath piston 70. Lower chamber 78 extends from barrier 69 to seal 65 located at a point generally noted as 83 and just above transducers 160 in FIG. 2E. The oil in reservoir 78 completely fills all space between housing section 12*c* and formation tester mandrel 54. The hydraulic oil in chamber 78 may be maintained at slightly greater pressure than the hydrostatic pressure of the drilling fluid in annulus 150. The annulus pressure is applied to piston 70 via drilling fluid entering chamber 72 through port 74. Because lower oil chamber 78 is a closed system, the annulus pressure that is applied via piston 70 is applied to the entire chamber 78. Additionally, spring 76 provides a slightly greater pressure to the closed oil system 78 such that the pressure in oil chamber 78 is substantially equal to the annulus fluid pressure plus the pressure added by the spring force. This slightly greater oil pressure is desirable so as to maintain positive pressure on all the seals in oil chamber 78. Having these two pressures generally balanced (even though the oil pressure is slightly higher) is easier to maintain than if there was a large pressure differential between the hydraulic oil and the drilling fluid. Between barrier 69 in piston 70 and point 83, the hydraulic oil fills all the space between the outside diameter of mandrels 52, 54 and the inside diameter of housing section 12*c*, this region being marked as distance 82 between points 81 and 83. The oil in reservoir 78 is employed in the hydraulic circuit 200 (FIG. 10) used to operate and control formation probe assembly 50 as described in more detailed below.

Figure 3:
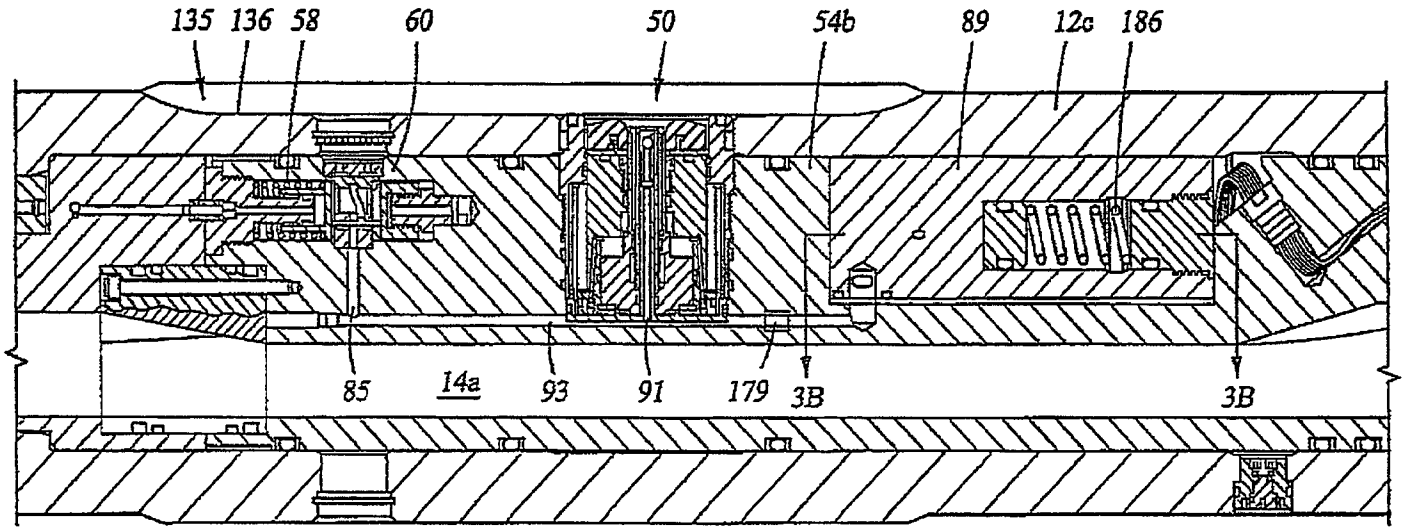
FIG. 3 is an enlarged elevation view, partly in cross-section, of the formation tester tool portion of the formation tester assembly shown in FIG. 2D.

Equalizer valve 60, best shown in FIG. 3, is disposed in formation tester mandrel 54*b* between hydraulic manifold 62 and formation probe assembly 50. Equalizer valve 60 is in fluid communication with hydraulic passageway 85 and with longitudinal fluid passageway 93 formed in mandrel 54*b*. Prior to actuating formation probe assembly 50 so as to test the formation, drilling fluid fills passageways 85 and 93 as valve 60 is normally open and communicates with annulus 150 through port 84 in the wall of housing section 12*e*. When the formation fluids are being sampled by formation probe assembly 50, valve 60 closes the passageway 85 to prevent drilling fluids from annulus 150 entering passageway 85 or passageway 93. A valve particularly well suited for use in this application is the valve described in U.S. patent application Ser. No. 10/440/637, filed May 19, 2003 and entitled "Equalizer Valve", hereby incorporated herein by reference for all purposes.

Figure 4:
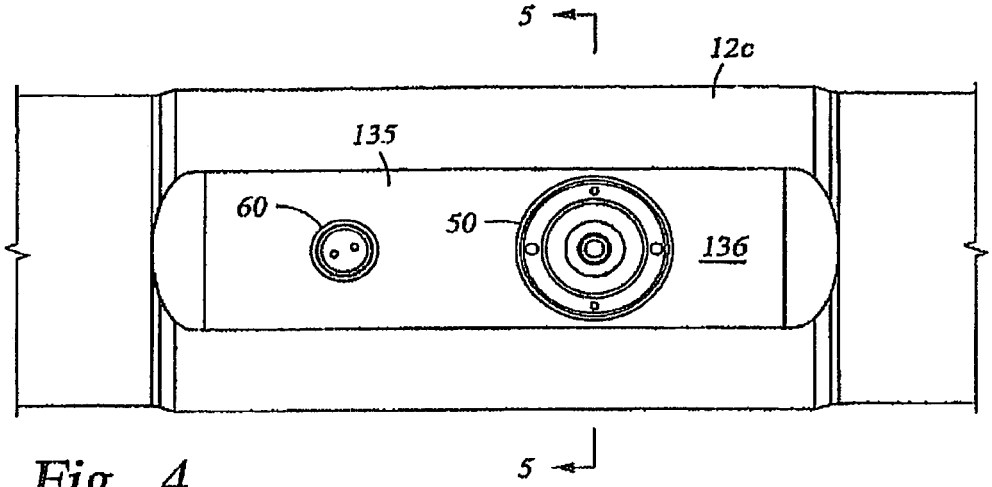
FIG. 4 is an elevation view of the formation tester tool shown in FIG. 3.

As shown in FIGS. 3 and 4, housing section 12*c* includes a recessed portion 135 adjacent to formation probe assembly 50 and equalizer valve 60. The recessed portion 135 includes a planar surface or "flat" 136. The ports through which fluids may pass into equalizing valve 60 and probe assembly 50 extend through flat 136. In this manner, as drill string 5 and formation tester 10 are rotated in the borehole, formation probe assembly 50 and equalizer valve 60 are better protected from impact, abrasion and other forces. Flat 136 is recessed at least ¼ A inch and may be at least ½ inch from the outer diameter of housing section 12*c*. Similar flats 137, 138 are also formed about housing section 12*c* at generally the same axial position as flat 136 to increase flow area for drilling fluid in the annulus 150 of borehole 8.

Disposed about housing section 12*c* adjacent to formation probe assembly 50 is stabilizer 154. Stabilizer 154 may have an outer diameter close to that of nominal borehole size. As explained below, formation probe assembly 50 includes a seal pad 140 that is extendable to a position outside of housing 12*c* to engage the borehole wall 151. As explained, probe assembly 50 and seal pad 140 of formation probe assembly 50 are recessed from the outer diameter of housing section 12*c*, but they are otherwise exposed to the environment of annulus 150 where they could be impacted by the borehole wall 151 during drilling or during insertion or retrieval of bottomhole assembly 6. Accordingly, being positioned adjacent to formation probe assembly 50, stabilizer 154 provides additional protection to the seal pad 140 during insertion, retrieval and operation of bottomhole assembly 6. It also provides protection to pad 140 during operation of formation tester 10. In operation, a piston extends seal pad 140 to a position where it engages the borehole wall 151. The force of the pad 140 against the borehole wall 151 would tend to move the formation tester 10 in the borehole, and such movement could cause pad 140 to become damaged. However, as formation tester 10 moves sideways within the borehole as the piston is extended into engagement with the borehole wall 151, stabilizer 154 engages the borehole wall and provides a reactive force to counter the force applied to the piston by the formation. In this manner, further movement of the formation test tool 10 is resisted.

Referring to FIG. 2E, mandrel 54*c* contains chamber 63 for housing pressure transducers 160 *a, c*, and *d* as well as electronics for driving and reading these pressure transducers. In addition, the electronics in chamber 63 contain memory, a microprocessor, and power conversion circuitry for properly utilizing power from power bus 700.

Referring still to FIG. 2E, housing section 12*d* includes pins ends 86, 87. Lower end 48 of housing section 12*e* threadingly engages upper end 86 of housing section 12*d*. Beneath housing section 12*d* and between formation tester tool 10 and drill bit 7 are other sections of the bottomhole assembly 6 that constitute conventional MWD tools, generally shown in FIG. 1 as MWD sub 13. In a general sense, housing section 12*d* is an adapter used to transition from the lower end of formation tester tool 10 to the remainder of the bottomhole assembly 6. The lower end 87 of housing section 12*d* threadingly engages other sub assemblies included in bottomhole assembly 6 beneath formation tester tool 10. As shown, flowbore 14 extends through housing section 12*d* to such lower subassemblies and ultimately to drill bit 7.

Figure 3A:
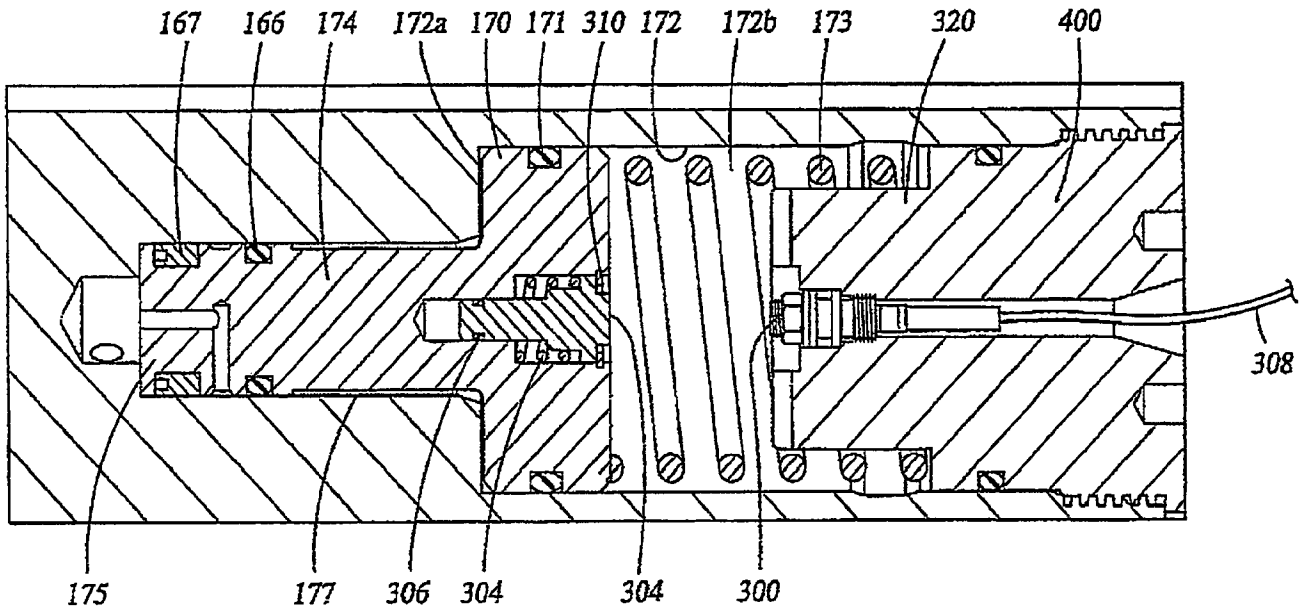
FIG. 3A is an enlarged cross-section view of the drawdown piston and chamber shown in FIG. 3.
Figure 3B:
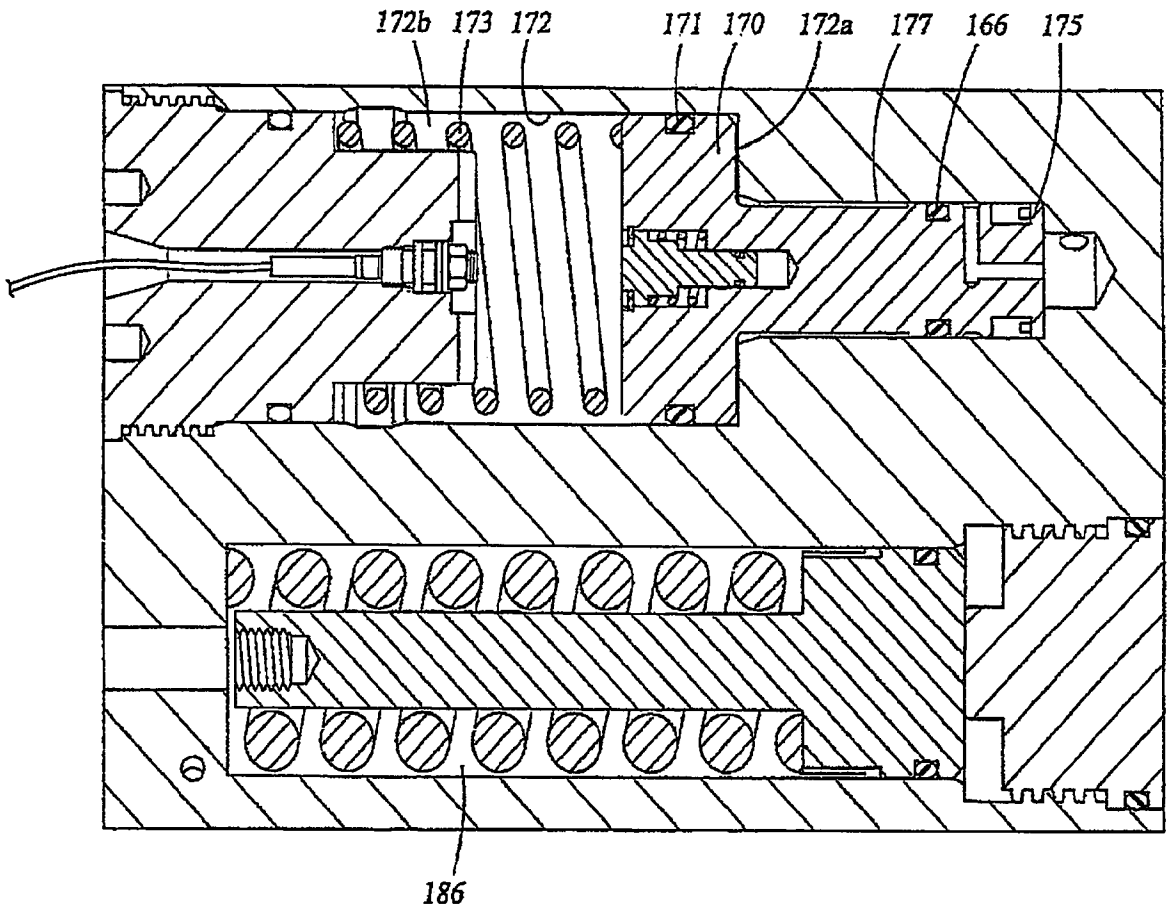
FIG. 3B is an enlarged cross-section view along line 3B-3B of FIG. 3.

Referring again to FIG. 3 and to FIG. 3A, drawdown piston 170 is retained in drawdown manifold 89 that is mounted on formation tester mandrel 54*b* within housing 12*c*. Piston 170 includes annular seal 171 and is slidingly received in cylinder 172. Spring 173 biases piston 170 to its uppermost or shouldered position as shown in FIG. 3A. Separate hydraulic lines (not shown) interconnect with cylinder 172 above and below piston 170 in portions 172*a*, 172*b* to move piston 170 either up or down within cylinder 172 as described more fully below. A plunger 174 is integral with and extends from piston 170. Plunger 174 is slidingly disposed in cylinder 177 coaxial with 172. Cylinder 175 is the upper portion of cylinder 177 that is in fluid communication with the longitudinal passageway 93 as shown in FIG. 3A. Cylinder 175 is flooded with drilling fluid via its interconnection with passageway 93. Cylinder 177 is filled with hydraulic fluid beneath seal 166 via its interconnection with hydraulic circuit 200. Plunger 174 also contains scraper 167 that protects seal 166 from debris in the drilling fluid. Scraper 167 may be an o-ring energized lip seal.

As best shown in FIG. 5, formation probe assembly 50 generally includes stem 92, a generally cylindrical adapter sleeve 94, piston 96 adapted to reciprocate within adapter sleeve 94, and a snorkel assembly 98 adapted for reciprocal movement within piston 96. Housing section 12*c* and formation tester mandrel 54*b* include aligned apertures 90*a*, 90*b*, respectively, that together form aperture 90 for receiving formation probe assembly 50.

Stem 92 includes a circular base portion 105 with an outer flange 106. Extending from base 105 is a tubular extension 107 having central passageway 108. The end of extension 107 includes internal threads at 109. Central passageway 108 is in fluid connection with fluid passageway 91 that, in turn, is in fluid communication with longitudinal fluid chamber or passageway 93, best shown in FIG. 3.

Adapter sleeve 94 includes inner end 111 that engages flange 106 of stem number 92. Adapter sleeve 94 is secured within aperture 90 by threaded engagement with mandrel 54*b* at segment 110. The outer end 112 of adapter sleeve 94 extends to be substantially flushed with flat 136 formed in housing member 12*c*. Circumferentially spaced about the outermost surface of adapter sleeve 94 is a plurality of tool engaging recesses 158. These recesses are employed to thread adapter 94 into and out of engagement with mandrel 54*b*. Adapter sleeve 94 includes cylindrical inner surface 113 having reduced diameter portions 114, 115. A seal 116 is disposed in surface 114. Piston 96 is slidingly retained within adapter sleeve 94 and generally includes base section 118 and an extending portion 119 that includes inner cylindrical surface 120. Piston 96 further includes central bore 121.

Snorkel 98 includes a base portion 125, a snorkel extension 126, and a central passageway 127 extending through base 125 and extension 126.

Formation tester apparatus 50 is assembled such that piston base 118 is permitted to reciprocate along surface 113 of adapter sleeve 94. Similarly, snorkel base 125 is disposed within piston 96 and snorkel extension 126 is adapted for reciprocal movement along piston surface 120. Central passageway 127 of snorkel 98 is axially aligned with tubular extension 107 of stem 92 and with screen 100.

Figure 6C:
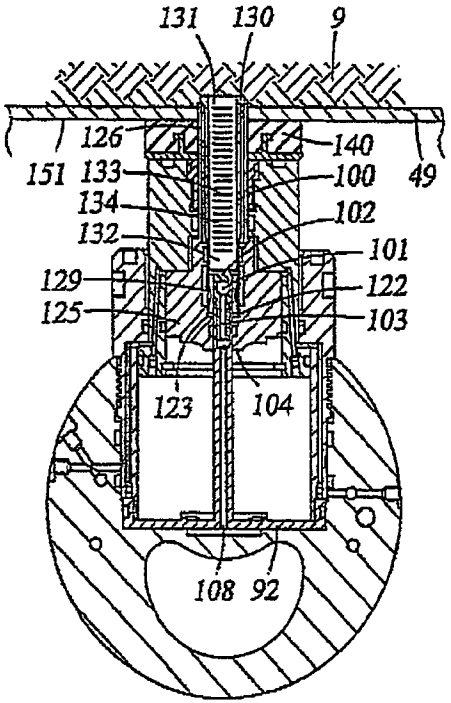
FIGS. 6A-6C are cross-sectional views of a portion of the formation probe assembly taken along the same line as seen in FIG. 5, the probe assembly being shown in a different position in each of FIGS. 6A-6C.

Referring to FIGS. 5 and 6C, screen 100 is a generally tubular member having a central bore 132 extending between a fluid inlet end 131 and outlet end 122. Outlet end 122 includes a central aperture 123 that is disposed about stem extension 107. Screen 100 further includes a flange 130 adjacent to fluid inlet end 131 and an internally slotted segment 133 having slots 134. Apertures 129 are formed in screen 100 adjacent end 122. Between slotted segment 133 and apertures 129, screen 100 includes threaded segment 124 for threadingly engaging snorkel extension 126.

Scraper 102 includes a central bore 103, threaded extension 104 and apertures 101 that are in fluid communication with central bore 103. Section 104 threadingly engages internally threaded section 109 of stem extension 107, and is disposed within central bore 132 of screen 100.

Referring now to FIGS. 5-9, the seal pad 140 may be generally donut-shaped having base surface 141, an opposite sealing surface 142 for sealing against the borehole wall, a circumferential edge surface 143 and a central aperture 144. In the embodiment shown, base surface 141 is generally flat and is bonded to a metal skirt 145. Seal pad 140 seals and prevents drilling fluid from entering the probe assembly 50 during formation testing so as to enable pressure transducers 160 to measure the pressure of the formation fluid. Changes in formation fluid pressure over time provide an indication of the permeability of the formation 9. More specifically, seal pad 140 seals against the mudcake 49 that forms on the borehole wall 151. Typically, the pressure of the formation fluid is less than the pressure of the drilling fluids that are injected into the borehole. A layer of residue from the drilling fluid forms a mudcake 49 on the borehole wall and separates the two pressure areas. Pad 140, when extended, conforms its shape to the borehole wall and, together with the mudcake 49, forms a seal through which formation fluids can be collected.

As best shown in FIGS. 3, 5, and 6, pad 140 is sized so that it can be retracted completely within aperture 90. In this position, pad 140 is protected both by flat 136 that surrounds aperture 90 and by recess 135 that positions face 136 in a setback position with respect to the outside surface of housing 12.

Pad 140 may be made of an elastomeric material having a high elongation characteristic. At the same time, the material may possess relatively hard and wear resistant characteristics. More particularly, the material may have an elongation % equal to at least 200% and even more than 300%. One such material useful in this application is Hydrogenated Nitrile Butadiene Rubber (HNBR). A material found particularly useful for pad 140 is HNBR compound number 372 supplied by Eutsler Technical Products of Houston, Tex. having a durometer hardness of 85 Shore A and a percent elongation of 370% at room temperature.

Figure 7:
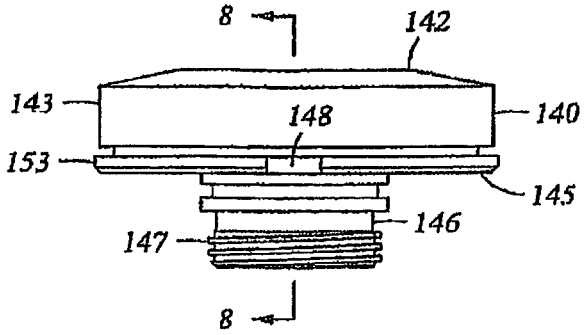
FIG. 7 is an elevation view of the probe pad mounted on the skirt as a preferred embodiment employed in the formation probe assembly shown in FIGS. 4 and 5.
Figure 8:
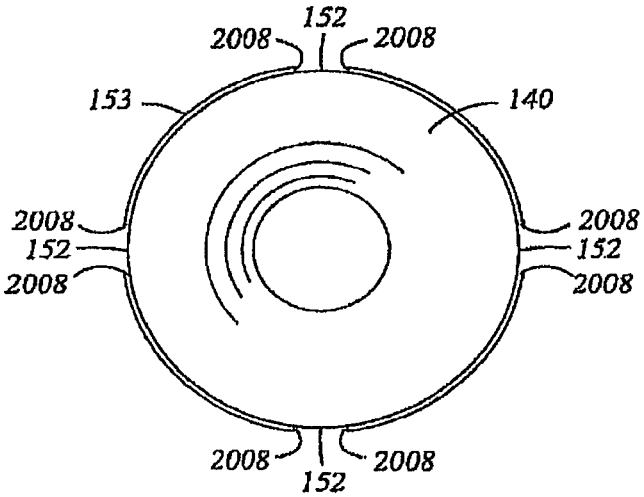
FIG. 8 is a top view of the probe pad shown in FIG. 7.
Figure 9:
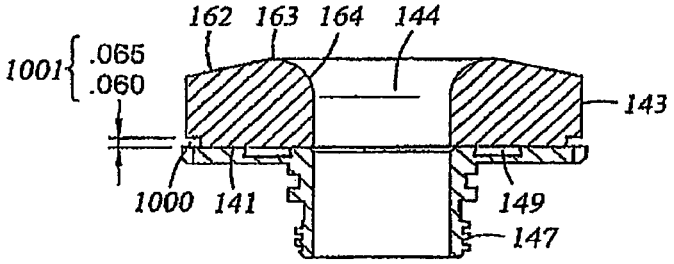
FIG. 9 is a cross-sectional view of the probe pad and skirt taken along line A-A in FIG. 7.

One possible profile for pad 140 is shown in FIGS. 7-9. Sealing surface 142 of pad 140 generally includes a spherical surface 162 and radius surface 164. Spherical surface 162 begins at edge 143 and extends to point 163 where spherical surface 162 merges into and thus becomes a part of radius surface 164. Radius surface 164 curves into central aperture 144 which passes through the center of the pad 140. In the embodiment shown in FIGS. 7-9, pad 140 includes an overall diameter of 2.25 inches with the diameter of central aperture 144 being equal to 0.75 inches. Radius surface 164 has a radius of 0.25 inches, and spherical surface 162 has a spherical radius equal to 4.25 inches. The height of the profile of pad 140 is 0.53 inches at its thickest point.

Referring again to FIGS. 7-9, when pad 140 is compressed, it may extrude into the recesses 152 in skirt 145. The corners 2008 of the recesses 152 can damage the pad, resulting in premature failure. An undercut feature 1000 shown in FIGS. 7 and 9 is cut into the pad to give space between the elastomeric pad 140 and the recesses 152.

As best shown in FIGS. 7 and 9, skirt 145 includes an extension 146 for threadingly engaging extending portion 119 of piston 96 (FIG. 5) at threaded segment 147 (FIGS. 7 and 9). Skirt 145 may also include dovetail groove 149*a* as shown in FIG. 9. When molded, the elastomer fills the dovetail groove. The groove acts to retain the elastomer in the event of de-bonding between the metal skirt 145 and the pad 140. When molded, the elastomer fills the counterbores. As shown in FIG. 5, snorkel extension 126 supports the central aperture 144 of pad 140 (FIG. 7) to reduce the extrusion of the elastomer when it is pressed against the borehole wall during a formation test. Reducing extrusion of the elastomer helps to ensure a good pad seal, especially against the high differential pressure seen across the pad during a formation test.

To help with a good pad seal, tool 10 may include, among other things, centralizers for centralizing the formation probe assembly 50 and thereby normalizing pad 140 relative to the borehole wall. For example, the formation tester may include centralizing pistons coupled to a hydraulic fluid circuit configured to extend the pistons in such a way as to protect the probe assembly and pad, and also to provide a good pad seal.

Figure 10:
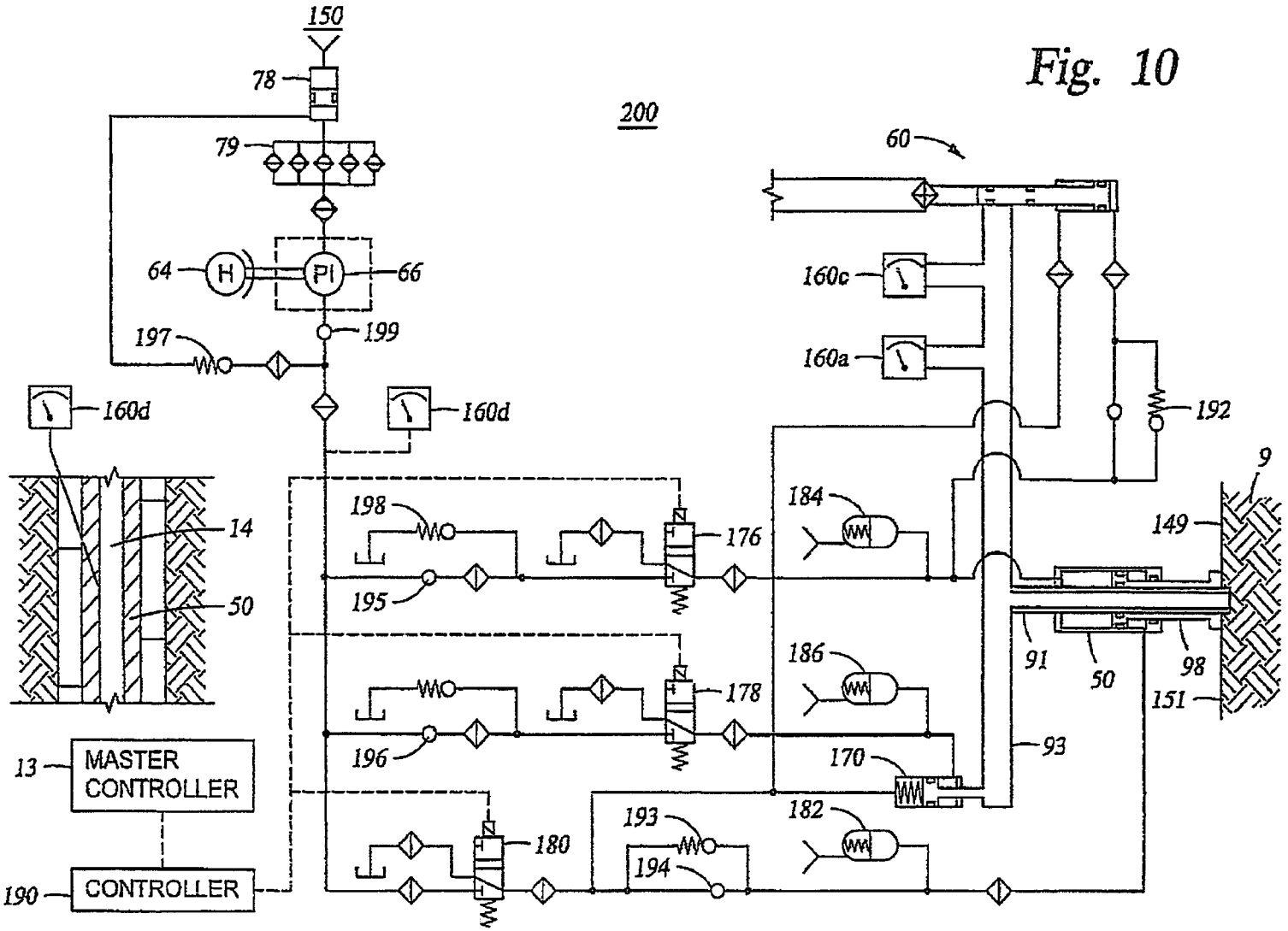
FIG. 10 is a schematic view of a hydraulic circuit employed in actuating the formation tester apparatus.

The hydraulic circuit 200 used to operate probe assembly 50, equalizer valve 60, and drawdown piston 170 is illustrated in FIG. 10. A microprocessor-based controller 190 is electrically coupled to all of the controlled elements in the hydraulic circuit 200 illustrated in FIG. 10, although the electrical connections to such elements are conventional and are not illustrated other than schematically. Controller 190 is located in electronics module 30 in housing section 12*a*, although it could be housed elsewhere in bottomhole assembly 6. Controller 190 detects the control signals transmitted from a master controller (not shown) housed in the MWD sub 13 of the bottomhole assembly 6 which, in turn, receives instructions transmitted from the surface via mud pulse telemetry, or any of various other conventional means for transmitting signals to downhole tools.

Controller 190 receives a command to initiate formation testing. This command may be received when the drill string is rotating or sliding or otherwise moving; however the drill string must be stationary during a formation test. As shown in FIG. 10, motor 64 is coupled to pump 66 that draws hydraulic fluid out of hydraulic reservoir 78 through a serviceable filter 79. As will be understood, the pump 66 directs, hydraulic fluid into hydraulic circuit 200 that includes formation probe assembly 50, equalizer valve 60, drawdown piston 170 and solenoid valves 176, 178, 180.

The operation of formation tester 10 is best understood in reference to FIG. 10 in conjunction with FIGS. 3A, 5 and 6A-C. In response to an electrical control signal, controller 190 energizes solenoid valve 180 and starts motor 64. Pump 66 then begins to pressurize hydraulic circuit 200 and, more particularly, charges probe retract accumulator 182. The act of charging accumulator 182 also ensures that the probe assembly 50 is retracted and that drawdown piston 170 is in its initial shouldered position as shown in FIG. 3A. When the pressure in system 200 reaches a predetermined value, such as 1800 psi as sensed by pressure transducer 160*b*, controller 190 (which continuously monitors pressure in the system) energizes solenoid valve 176 and de-energizes solenoid valve 180, which causes probe piston 96 and snorkel 98 to begin to extend toward the borehole wall 151. Concurrently, check valve 194 and relief valve 193 seal the probe retract accumulator 182 at a pressure charge of between approximately 500 to 1250 psi.

Figure 6B:
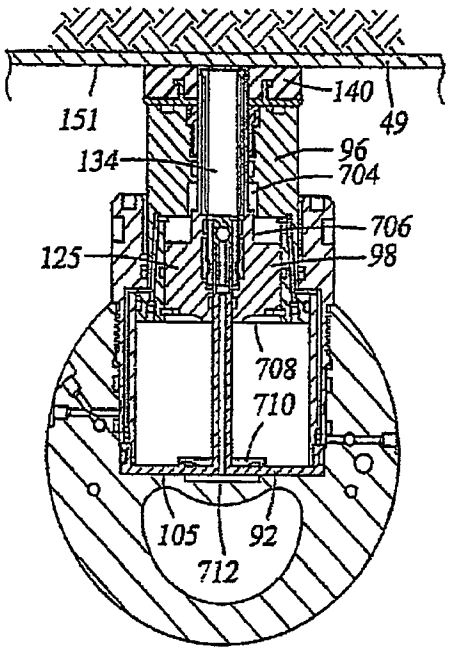
Figure 6A:
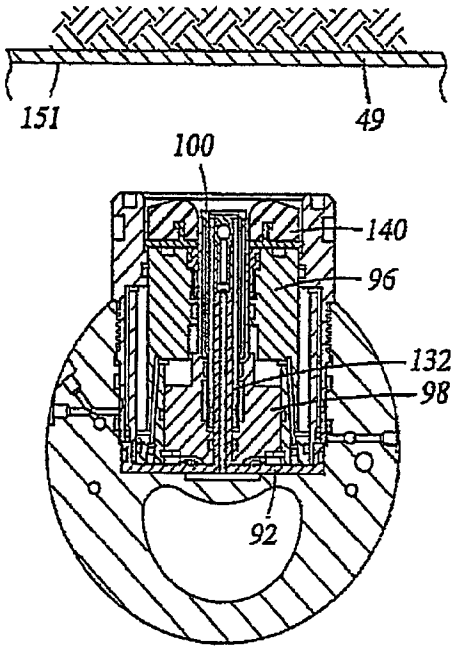

Piston 96 and snorkel 98 extend from the position shown in FIG. 6A to that shown in FIG. 6B where pad 140 engages the mudcake 49 on borehole wall 151. With hydraulic pressure continued to be supplied to the extend side of the piston 96 and snorkel 98, the snorkel then penetrates the mudcake as shown in FIG. 6C. There are two expanded positions of snorkel 98, generally shown in FIGS. 6B and 6C. The piston 96 and snorkel 98 move outwardly together until the pad 140 engages the borehole wall 151. This combined motion continues until the force of the borehole wall against pad 140 reaches a pre-determined magnitude, for example 5,500 lb, causing pad 140 to be squeezed. At this point, a second stage of expansion takes place with snorkel 98 then moving within the cylinder 120 in piston 96 to penetrate the mudcake 49 on the borehole wall 151 and to receive formation fluids.

In one method, as seal pad 140 is pressed against the borehole wall, the pressure in circuit 200 rises and when it reaches a predetermined pressure, valve 192 opens so as to close equalizer valve 60, thereby isolating fluid passageway 93 from the annulus. In this manner, valve 192 ensures that valve 60 closes only after the seal pad 140 has entered contact with mudcake 49 that lines borehole wall 151. In another method, as seal pad 140 is pressed against the borehole wall 151, the pressure in circuit 200 rises and closes equalizer valve 60, thereby isolating fluid passageway 93 from the annulus. In this manner, the valve 60 may close before the seal pad 140 has entered contact with mudcake 49 that lines borehole wall 151. Passageway 93, now closed to the annulus 150, is in fluid communication with cylinder 175 at the upper end of cylinder 177 in drawdown manifold 89, best shown in FIG. 3A.

With solenoid valve 176 still energized, probe seal accumulator 184 is charged until the system reaches a predetermined pressure, for example 1800 psi, as sensed by pressure transducer 160*b*. When that pressure is reached, a delay may occur before controller 190 energizes solenoid valve 178 to begin drawdown. This delay, which is controllable, can be used to measure properties of the mudcake 49 that lines borehole wall 151. Energizing solenoid valve 178 permits pressurized fluid to enter portion 172*a* of cylinder 172 causing drawdown piston 170 to retract. When that occurs, plunger 174 moves within cylinder 177 such that the volume of fluid passageway 93 increases by the volume of the area of the plunger 174 times the length of its stroke along cylinder 177. This movement increases the volume of cylinder 175, thereby increasing the volume of fluid passageway 93. For example, the volume of fluid passageway 93 may be increased by 10 cc as a result of piston 170 being retracted.

As drawdown piston 170 is actuated, formation fluid may thus be drawn through central passageway 127 of snorkel 98 and through screen 100. The movement of drawdown piston 170 within its cylinder 172 lowers the pressure in closed passageway 93 to a pressure below the formation pressure, such that formation fluid is drawn through screen 100 and snorkel 98 into aperture 101, then through stein passageway 108 to passageway 91 that is in fluid communication with passageway 93 and part of the same closed fluid system. In total, fluid chambers 93 (which include the volume of various interconnected fluid passageways, including passageways in probe assembly 50, passageways 85, 93 (FIG. 3), the passageways interconnecting 93 with drawdown piston 170 and pressure transducers 160*a,c*) may have a volume of approximately 40 cc. Drilling mud in annulus 150 is not drawn into snorkel 98 because pad 140 seals against the mudcake. Snorkel 98 serves as a conduit through which the formation fluid may pass and the pressure of the formation fluid may be measured in passageway 93 while pad 140 serves as a seal to prevent annular fluids from entering the snorkel 98 and invalidating the formation pressure measurement.

Referring momentarily to FIGS. 5 and 6C, formation fluid is drawn first into the central bore 132 of screen 100. It then passes through slots 134 in screen slotted segment 133 such that particles in the fluid are filtered from the flow and are not drawn into passageway 93. The formation fluid then passes between the outer surface of screen 100 and the inner surface of snorkel extension 126 where it next passes through apertures 123 in screen 100 and into the central passageway 108 of stem 92 by passing through apertures 101 and central passage bore 103 of scraper 102.

Referring again to FIG. 10, with seal pad 140 sealed against the borehole wall, check valve 195 maintains the desired pressure acting against piston 96 and snorkel 98 to maintain the proper seal of pad 140. Additionally, because probe seal accumulator 184 is fully charged, should tool 10 move during drawdown, additional hydraulic fluid volume may be supplied to piston 96 and snorkel 98 to ensure that pad 140 remains tightly sealed against the borehole wall. In addition, should the borehole wall 151 move in the vicinity of pad 140, the probe seal accumulator 184 will supply additional hydraulic fluid volume to piston 96 and snorkel 98 to ensure that pad 140 remains tightly sealed against the borehole wall 151. Without accumulator 184 in circuit 200, movement of the tool 10 or borehole wall 151, and thus of formation probe assembly 50, could result in a loss of seal at pad 140 and a failure of the formation test.

With the drawdown piston 170 in its fully retracted position and formation fluid drawn into closed system 93, the pressure will stabilize and enable pressure transducers 160*a,c* to sense and measure formation fluid pressure. The measured pressure is transmitted to the controller 190 in the electronic section where the information is stored in memory and, alternatively or additionally, is communicated to the master controller in the MWD tool 13 below formation tester 10 where it can be transmitted to the surface via mud pulse telemetry or by any other conventional telemetry means.

When drawdown is completed, piston 170 actuates a contact switch 320 mounted in endcap 400 and piston 170, as shown in FIG. 3A. The drawdown switch assembly consists of contact 300, wire 308 coupled to contact 300, plunger 302, spring 304, ground spring 306, and retainer ring 310. Piston 170 actuates switch 320 by causing plunger 302 to engage contact 300 that causes wire 308 to couple to system ground via contact 300 to plunger 302 to ground spring 306 to piston 170 to endcap 400 that is in communication with system ground (not shown).

When the contact switch 320 is actuated, controller 190 responds by shutting down motor 64 and pump 66 for energy conservation. Check valve 196 traps the hydraulic pressure and maintains piston 170 in its retracted position. In the event of any leakage of hydraulic fluid that might allow piston 170 to begin to move toward its original shouldered position, drawdown accumulator 186 will provide the necessary fluid volume to compensate for any such leakage and thereby maintain sufficient force to retain piston 170 in its retracted position.

Controller 190 also responds by continuously monitoring the pressure in fluid passageway 93 via pressure transducers 160*a,c* until this fluid pressure increases, or builds up, to the formation pressure, or until a predetermined time interval has elapsed. During buildup, if the controller 190 determines, based on the fluid pressure, the formation pressure, and the amount of time elapsed during buildup, that the fluid pressure is increasing too slowly, the controller 190 may cause piston 170 to translate within cylinder 172 so as to decrease the volume of passageway 93. Decreasing the volume of passageway 93 increases the pressure of fluid contained within the passageway 93. Thus, the fluid pressure is increased toward the formation pressure, and the length of time required for buildup to the formation pressure is reduced.

In some embodiments, controller 190 may actuate piston 170 in this manner only once during a formation test. In other embodiments, the controller 190 may actuate piston 170 two or more times as necessary. In either scenario, the fluid pressure after translation of piston 170 may exceed the formation pressure, and then as time passes, decrease to the formation pressure. Alternatively, the fluid pressure may be less than the formation pressure and then, as buildup continues, increase to the formation pressure.

In still other embodiments, the controller 190 may be configured to actuate piston 170 to translate within cylinder 172 automatically upon completion of drawdown, rather than waiting until buildup has begun and actuating the piston 170 depending on the fluid pressure.

Figure 12:
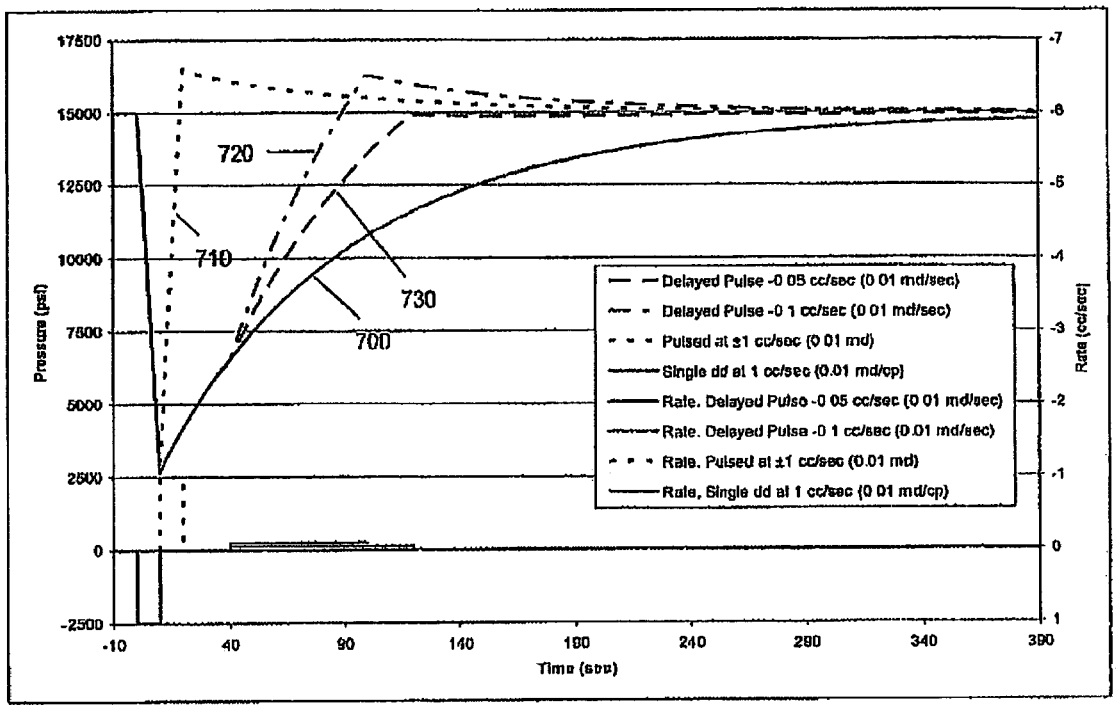
FIG. 12 illustrates formation fluid pressure for different pulse methods.

Movement of piston 170 within cylinder 172 during and/or just prior to buildup may occur at a defined rate over a specific time period. For example, as illustrated in FIG. 12 discussed below, the piston 170 may translate to decrease the volume of the cylinder 172 by 0.05 cc/sec or 0.1 cc/sec. Moreover, the rate which piston 170 translates within cylinder 172 may be increased or decreased as necessary, depending on the fluid pressure. Alternatively, movement of piston 170 may be controlled such that piston 170 translates a fixed amount to provide a pre-defined volume for passageway 93. Movement of piston 170 may be steady, occur as a pulse, so to speak, multiple pulses, or any combination thereof.

When buildup is complete (meaning the pressure of fluid within passageway 93 is at or near the formation pressure), or after a predetermined time interval, controller 190 de-energizes solenoid valve 176. De-energizing solenoid valve 176 removes pressure from the close side of equalizer valve 60 and from the extend side of probe piston 96. Spring 58 then returns the equalizer valve 60 to its normally open state and probe retract accumulator 182 will cause piston 96 and snorkel 98 to retract, such that seal pad 140 becomes disengaged with the borehole wall. Thereafter, controller 190 again powers motor 64 to drive pump 66 and again energizes solenoid valve 180. This step ensures that piston 96 and snorkel 98 have fully retracted and that the equalizer valve 60 is opened. Given this arrangement, the formation tool 10 has a redundant probe retract mechanism. Active retract force is provided by the pump 66. A passive retract force is supplied by probe retract accumulator 182 that is capable of retracting the probe even in the event that power is lost. Accumulator 182 may be charged at the surface before being employed downhole to provide pressure to retain the piston and snorkel in housing 12*c*.

Referring again briefly to FIGS. 5 and 6, as piston 96 and snorkel 98 are retracted from their position shown in FIG. 6C to that of FIG. 6B, screen 100 is drawn back into snorkel 98. As this occurs, the flange on the outer edge of scraper 102 drags and thereby scrapes the inner surface of screen member 100. In this manner, material screened from the formation fluid upon its entering of screen 100 and snorkel 98 is removed from screen 100 and deposited into the annulus 150. Similarly, scraper 102 scrapes the inner surface of screen member 100 when snorkel 98 and screen 100 are extended toward the borehole wall.

After a predetermined pressure, for example 1800 psi, is sensed by pressure transducer 160*b* and communicated to controller 190 (indicating that the equalizer valve is open and that the piston and snorkel are fully retracted), controller 190 de-energizes solenoid valve 178 to remove pressure from side 172*a* of drawdown piston 170. With solenoid valve 180 remaining energized, positive pressure is applied to side 172*b* of drawdown piston 170 to ensure that piston 170 is returned to its original position (as shown in FIG. 3). Controller 190 monitors the pressure via pressure transducer 160*b* and when a predetermined pressure is reached, controller 190 determines that piston 170 is fully returned and it shuts off motor 64 and pump 66 and de-energizes solenoid valve 180. With all solenoid valves 176, 178, 180 returned to their original position and with motor 64 off, tool 10 is back in its original condition and drilling can again be commenced.

Relief valve 197 protects the hydraulic system 200 from overpressure and pressure transients. Various additional relief valves may be provided. Thermal relief valve 198 protects trapped pressure sections from overpressure. Check valve 199 prevents back flow through the pump 66.

An exemplary formation tester 10 and illustrative methods of its use have been described with reference to FIGS. 1 through 10. It is to be understood that other embodiments of formation testers may be employed.

Figure 11:
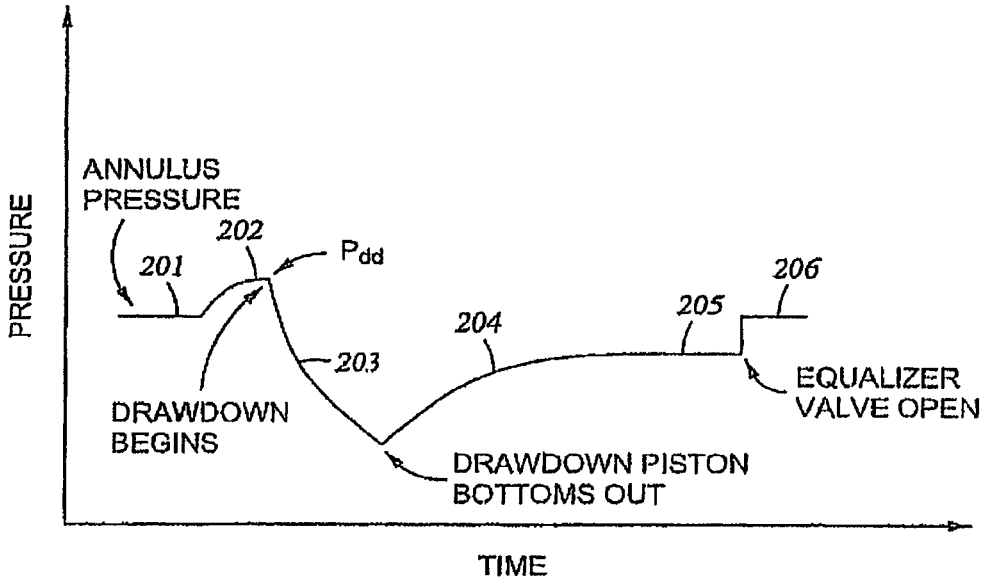
FIG. 11 is a graph of the formation fluid pressure as compared to time measured during operation of the tester apparatus.

FIG. 11 illustrates a pressure versus time graph illustrating an example of the pressure sensed by pressure transducer 160*a,c* during the operation of formation tester 10. As the formation fluid is drawn within the tester 10, pressure readings are taken by transducers 160*a,c*. The sensed pressure will initially be equal to the annulus pressure shown at point 201. As pad 140 is extended and equalizer valve 60 is closed, there will be a slight increase in pressure as shown at 202. This occurs when the pad 140 seals against the borehole wall 151 and squeezes the drilling fluid trapped in the now-isolated passageway 93.

As drawn down piston 170 is actuated, the volume of the closed chamber 93 increases, causing the pressure to decrease as shown in region 203. This is known as the pretest drawdown. The combination of the flow rate and snorkel ID determines an effective range of operation. When the drawn down piston bottoms out within cylinder 172, a differential pressure with the formation fluid exists causing the fluid in the formation to move towards the low pressure area and, therefore, causing the pressure to build over time as shown in region 204. The pressure begins to stabilize, and at point 205, achieves the pressure of the formation fluid in the zone being tested at the borehole wall. After a fixed time, such as three minutes after the end of region 203, the equalizer valve 60 is again opened, and the pressure within chamber 93 equalizes back to the annulus pressure as shown at 206.

FIG. 12 illustrates representative example formation test pressure curves, including a pressure curve 700, a pressure curve 710, a pressure curve 720, and a pressure curve 730, for different methods of pulse testing. The pressure curve 700 is generated using pressure data recorded during formation testing in the absence of reducing the sample chamber volume to speed up the test. As shown in FIG. 12, approximately 390 seconds are needed for the fluid pressure in the sample chamber to buildup to near the formation pressure.

The pressure curves 710, 720, 730 illustrate the reduction in testing time resulting from the apparatus and methods disclosed herein. The pressure curve 710 results from a reduction in the sample chamber volume at the onset of buildup at time equal to 0 seconds. The pressure curves 720, 730 result from a delayed reduction in the sample chamber volume, occurring at approximately 40 seconds into buildup. Moreover, for all three of the pressure curves 710, 720, 730, the sample chamber volume was reduced at a different rate. Also, the time required for the fluid pressure to approach the formation pressure in all three tests is nearly half of that required where the sample chamber volume was not changed during testing.

Figure 13:
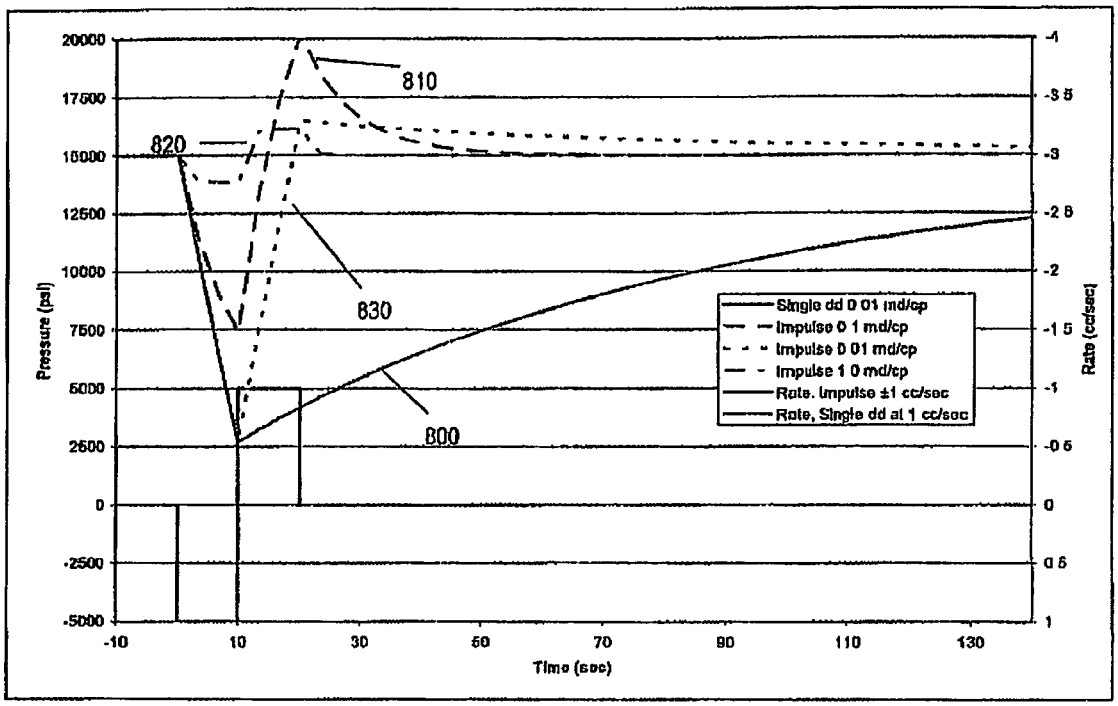
FIG. 13 illustrates formation fluid pressure for different formation mobilities.

FIG. 13 illustrates representative formation test pressure curves 810, 820, 830 resulting from formation testing using a pulse method with different formation mobilities. In this figure, a single pulse has been applied, meaning the sample chamber volume has been reduced, during tests represented by pressure curves 810, 820, 830, whereas the sample chamber volume was not modified during the test represented by pressure curve 800. As illustrated in FIG. 13, the time required to reach formation pressure is reduced by the pulse formation testing method in each of the example pressure curves 810, 820, 830 as opposed to the non-pulse testing method represented by the pressure curve 800.

Figure 14:
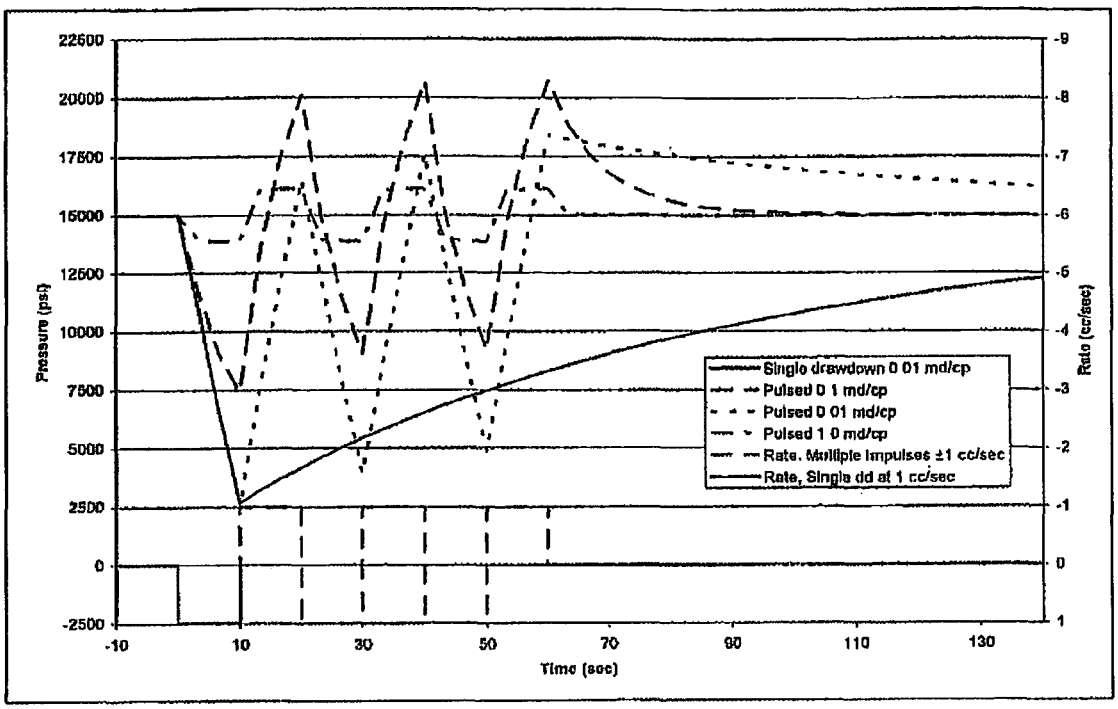
FIG. 14 illustrates formation fluid pressure for multiple pulse methods.

FIG. 14 illustrates representative formation test pressure curves using multiple pulses within a single pressure test with different formation mobilities. The pressure curves shown in FIG. 14 illustrate how multiple pulses can be applied for interpretation purposes. While not necessary, the pulses may also be monitored by a probe displaced vertically or azimuthally from the source probe to determine horizontal and vertical permeabilities (and mobilities) similar to the methods discussed in U.S. Pat. No. 5,672,819, titled "Formation Evaluation Using Phase Shift Periodic Pressure Pulse Testing," all of which is hereby incorporated herein by reference for all purposes. An additional example of multi-probe pressure transient analysis is discussed in U.S. Pat. No. 7,059,179, entitled "Multi-Probe Pressure Transient Analysis for Determination of Horizontal Permeability, Anisotropy and Skin in an Earth Formation," also hereby incorporated herein by reference for all purposes. The pulses shown in FIG. 14 do not necessarily need to be symmetric but may be varied to optimize the interpretation or reduce testing time for actual future pressure tests.

Additional materials included as part of this disclosure include:

1. "Downhole Formation Fluid Identification in a Mature Multi-Layer Reservoir: A Case Study of an Advanced Wireline Formation Tester and Operational Practices for Highly Depleted Reservoir Evaluation," SPE 88634 and related presentation materials labeled "Tight Gas Sand Test Example 1" and "Tight Gas Sand Test Example 2;"
2. "New Exact Spherical Flow Solution With Storage and Skin for Early-Time Interpretation With Application to Wireline Formation and Early-Evaluation Drillstem Testing," SPE 49140;
3. "Advanced Dual Probe Formation Tester with Transient, Harmonic, and Pulsed Time-Delay Testing Methods Determines Permeability, Skin, and Anisotropy," SPE 64650; and
4. Invention Disclosure by Mark A. Proett entitled, "Apparatus and Method for Pulse Testing Formations," dated Aug. 14, 2007.

While specific embodiments have been illustrated and described, one skilled in the art can make modifications without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method for measuring properties of a formation with a borehole extending there through including:

disposing a formation tester within the borehole, the formation tester including:

a cylinder with a drawdown piston slideably disposed therein, the drawdown piston translatable from a first position toward a second position at a specified flow rate to draw formation fluid into the cylinder; and a sealing assembly extendable into engagement with the borehole wall that isolates an area of the borehole wall from borehole fluid with the isolated area hydraulically connected to the cylinder;

a pressure sensor to measure pressure at one of the sealing assembly and the cylinder; and performing a test sequence, including:

extending the sealing assembly into engagement with the borehole wall;

drawing formation fluid into the formation tester through the sealing assembly by translating the drawdown piston toward the second position;

injecting the formation fluid back into the formation through the sealing assembly by translating the drawdown piston from the second position toward the first position to an intermediate position such that the fluid pressure in the sealing assembly after the translation of the piston exceeds the formation pressure, and thereafter holding the piston in the intermediate position for a period of time and measuring pressure; and determining a property of the formation.

2. The method of claim 1, wherein the formation property is at least one of formation pressure, permeability, spherical permeability, fluid type, fluid quality, formation temperature, bubblepoint, formation pressure gradient, mobility, spherical mobility, filtrate viscosity, fluid compressibility, compressibility, coupled compressibility porosity, skin, skin damage, anisotropy, and porosity.

3. The method of claim 1, wherein the test sequence further includes translating the drawdown piston to or in between the first and second positions multiple times.

4. The method of claim 1, further including monitoring the pressure in the borehole at a location displaced from the probe assembly.

5. The method of claim 1, further including allowing the formation fluid in the formation tester to stabilize to formation pressure after translating the drawdown piston to the intermediate position.

6. The method of claim 1, wherein the pressure of the fluid in the formation tester increases to the formation pressure after the drawdown piston is translated to the intermediate position.

7. The method of claim 1, wherein the pressure of the fluid in the formation tester decreases to the formation pressure after the drawdown piston is translated to the intermediate position.

8. The method of claim 7, where the property is formation pressure determined by matching the decreasing pressure of the fluid in the formation tester to a function to determine the formation properties comprising one or more of formation pressure, spherical mobility, spherical permeability, anisotropy, skin, compressibility, and porosity.

9. The method of claim 1, wherein at least one of rate, volume, and time period of drawdown piston translation is selectable from a plurality of values.

10. The method of claim 1, further including resetting the drawdown piston towards another intermediate position when a property of the drawn formation fluid is changing at a slower than desired rate.

11. The method of claim 1, wherein the sealing assembly comprises a probe assembly.

12. The method of claim 1, wherein the pressure sensor measures pressure at the sealing assembly.

13. The method of claim 1, wherein the pressure sensor measures pressure at the cylinder.

14. The method of claim 1, including a first pressure sensor to measure pressure at the sealing assembly and a second pressure sensor to measure pressure at the cylinder.

15. A method for measuring properties of a formation with a borehole extending therethrough, including:

wherein at least one drawdown of a drawdown piston from a first position to a second position in a cylinder to draw formation fluid from the formation is followed by at least one translation of the drawdown piston to a position intermediate of the first and second positions, translation of the drawdown piston to the intermediate position injecting formation fluid back into the formation, and thereafter holding the drawdown piston in the intermediate position for a period of time and measuring the pressure in the cylinder; and measuring a property of the formation.

16. The method of claim 15, wherein the formation property is at least one of formation pressure, permeability, spherical permeability, fluid type, fluid quality, formation temperature, bubblepoint, formation pressure gradient, mobility, spherical mobility, filtrate viscosity, fluid compressibility, compressibility, coupled compressibility porosity, skin, skin damage, anisotropy, and porosity.

17. The method of claim 15, wherein the test sequence further includes translating the drawdown piston to or in between the first and second positions multiple times.

18. The method of claim 15, further including allowing the formation fluid in the formation tester to stabilize to formation pressure after translating the drawdown piston to the intermediate position.

19. The method of claim 15, wherein the pressure of the fluid in the formation tester increases to the formation pressure after the drawdown piston is translated to the intermediate position.

20. The method of claim 15, wherein the pressure of the fluid in the formation tester decreases to the formation pressure after the drawdown piston is translated to the intermediate position.

21. The method of claim 20, where the property is formation pressure determined by matching the decreasing pressure of the fluid in the formation tester to a function to determine the formation properties comprising one or more of formation pressure, spherical mobility, spherical permeability, anisotropy, skin, compressibility, and porosity.

22. The method of claim 15, wherein at least one of rate, volume, and time period of drawdown piston is selectable from a plurality of values.

23. The method of claim 15, further including resetting the drawdown piston towards an intermediate position when a property of the drawn formation fluid is changing at a slower than desired rate.

* * * * *